US011631552B2

(12) United States Patent
Huang et al.

(10) Patent No.: US 11,631,552 B2
(45) Date of Patent: Apr. 18, 2023

(54) KEYSWITCH

(71) Applicants: LITE-ON Technology (Chang Zhou) Co., LTD., Jiangsu Province (CN); LITE-ON Technology Corporation, Taipei (TW)

(72) Inventors: Bin Huang, Jiangsu Province (CN); Wei-Pin Chuang, Taipei (TW); XiaoQiang Liang, Jiangsu Province (CN)

(73) Assignees: Lite-On Technology (Chang Zhou) Co., Ltd., Jiangsu Province (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 17/027,037

(22) Filed: Sep. 21, 2020

(65) Prior Publication Data

US 2021/0257168 A1 Aug. 19, 2021

(30) Foreign Application Priority Data

Feb. 14, 2020 (CN) ..... 202010092707.5

(51) Int. Cl.
*H01H 3/12* (2006.01)
*H01H 13/704* (2006.01)
*H01H 13/705* (2006.01)

(52) U.S. Cl.
CPC ..... *H01H 3/125* (2013.01); *H01H 13/704* (2013.01); *H01H 13/705* (2013.01)

(58) Field of Classification Search
CPC ..... H01H 2221/062; H01H 2221/044; H01H 3/125; H01H 13/705; H01H 13/14;
(Continued)

(56) References Cited

U.S. PATENT DOCUMENTS

2010/0108481 A1* 5/2010 Chiang ..... H01H 13/83 200/310
2010/0288615 A1* 11/2010 Mafune ..... H01H 13/83 200/5 A (Continued)

FOREIGN PATENT DOCUMENTS

CN 202662498 U 1/2013
CN 202905546 U 4/2013

(Continued)

OTHER PUBLICATIONS

China Patent Office, First Search Report, Application No. 2020100927075, dated Sep. 3, 2021, 2 pages.

*Primary Examiner* — Ahmed M Saeed
(74) *Attorney, Agent, or Firm* — Umberg Zipser LLP; Ryan Dean

(57) ABSTRACT

The present disclosure provides a keyswitch comprising a baseplate, a circuit layer, an elastic part, a thin film, a keycap, and a linkage component. The circuit layer is disposed on the baseplate. The baseplate penetrates and is exposed from the circuit layer. The elastic part is disposed on the circuit layer. The thin film is disposed on the circuit layer. The thin film is provided with an opening. The baseplate penetrates and is exposed from the opening. The elastic part protrudes from the opening. The keycap is disposed above the elastic part and covers the elastic part. Two ends of the linkage component are respectively connected to the baseplate and the keycap. The elastic part is disposed in the linkage component. The linkage component drives the keycap to move up and down relative to the baseplate. The thin film is disposed on the movement path of the keycap.

20 Claims, 13 Drawing Sheets

(58) Field of Classification Search
CPC .. H01H 13/70; H01H 13/704; H01H 13/7065; H01H 13/7006; H01H 13/7057; H01H 13/78; H01H 13/79; H01H 13/52; H01H 13/703; H01H 13/507; H01H 13/04; H01H 13/10; H01H 3/12; H01H 13/20
See application file for complete search history.

(56) References Cited

U.S. PATENT DOCUMENTS

| | | | | |
|---|---|---|---|---|
| 2011/0155551 | A1* | 6/2011 | Yamada | H01H 13/705 200/5 A |
| 2016/0351350 | A1* | 12/2016 | Yamada | H01H 3/125 |
| 2018/0197692 | A1* | 7/2018 | Chen | H01H 13/705 |
| 2018/0254156 | A1* | 9/2018 | Yang | H01H 13/83 |
| 2018/0350537 | A1 | 12/2018 | Liao et al. | |
| 2019/0171297 | A1* | 6/2019 | Lin | G06F 3/0202 |
| 2020/0051762 | A1* | 2/2020 | Chang | H01H 13/84 |

FOREIGN PATENT DOCUMENTS

| | | | |
|---|---|---|---|
| CN | 204155813 | U | 2/2015 |
| CN | 206774432 | U | 12/2017 |

* cited by examiner

KEYSWITCH

CROSS REFERENCE TO RELATED APPLICATION

This application claims the priority benefit of Chinese Patent Application Serial Number CN202010092707.5, filed on Feb. 14, 2020, the full disclosure of which is incorporated herein by reference.

BACKGROUND

Technical Field

The present disclosure relates to the technical field of input devices, particularly to a keyswitch.

Related Art

The keyswitch of conventional keyboard comprises a metal baseplate, a circuit layer, an elastic pad, a linkage component, and a keycap. The circuit layer is disposed on the metal baseplate. The elastic pad is disposed on the circuit layer. The keycap is disposed above the circuit layer and covers the elastic pad. The two ends of the linkage component are connected to the keycap and the metal baseplate. When the keycap is pressed, the keycap moves up and down relative to the metal baseplate with the linkage component. When the keycap moves towards the metal baseplate, an impact noise would be made from a sidewall of the keycap hitting onto the circuit layer in which a metal circuit is disposed without any buffering spaces. The impact noise would be even louder with metal or ceramic keycaps.

SUMMARY

The embodiments of the present disclosure provide a keyswitch to solve the problem of impact noise made from the keycap hitting onto the circuit layer.

In the first aspect, the present disclosure provides a keyswitch comprising a baseplate, a circuit layer, an elastic part, a thin film, a keycap, and a linkage component. The circuit layer is disposed on the baseplate. The elastic part is disposed on the circuit layer. The thin film is disposed on the circuit layer. The thin film is provided with an opening. The elastic part protrudes from the opening. The keycap is disposed on the elastic part. Two ends of the linkage component are respectively connected to the baseplate and the keycap. The linkage component drives the keycap to move up and down relative to the baseplate. The thin film is disposed on the movement path of the keycap.

In the second aspect, the present disclosure provides a keyswitch comprising a baseplate, a circuit layer, a thin film, an elastic part, a keycap, and a linkage component. The circuit layer is disposed on the baseplate. The thin film is disposed on the circuit layer. The elastic part is disposed on the circuit layer. The elastic part is engaged with a surface of the circuit layer. The keycap disposed on the elastic part. The keycap comprises a keycap body and a sidewall connected to a periphery of the keycap body. The linkage component on which the two ends are respectively connected to the baseplate and the keycap. The orthographic projection area projected by an outer edge of the keycap facing the thin film is on the thin film.

In the third aspect, the present disclosure provides a keyswitch comprising a baseplate, a circuit layer, an elastic part, at least one thin film, a keycap, a linkage component.

The circuit layer is disposed on the baseplate. The elastic part is disposed on the circuit layer. The at least one thin film is disposed on the circuit layer. The thin film and the circuit layer are two independent parts. The keycap is disposed above the at least one thin film. The keycap covers the elastic part. Two ends of the linkage component are respectively connected to the baseplate and the keycap. The linkage component is disposed on a periphery of the elastic part. The keycap moves up and down relative to the baseplate. The at least one thin film is disposed between the keycap and the circuit layer.

In the embodiments of the present disclosure, the keycap would not be directly impacting the circuit layer by disposing thin films on the circuit layer and the movement path of the keycap. The thin films are cushioning films with pliability, which eliminates the impacting noise and enhances the quietness of the keyswitch.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
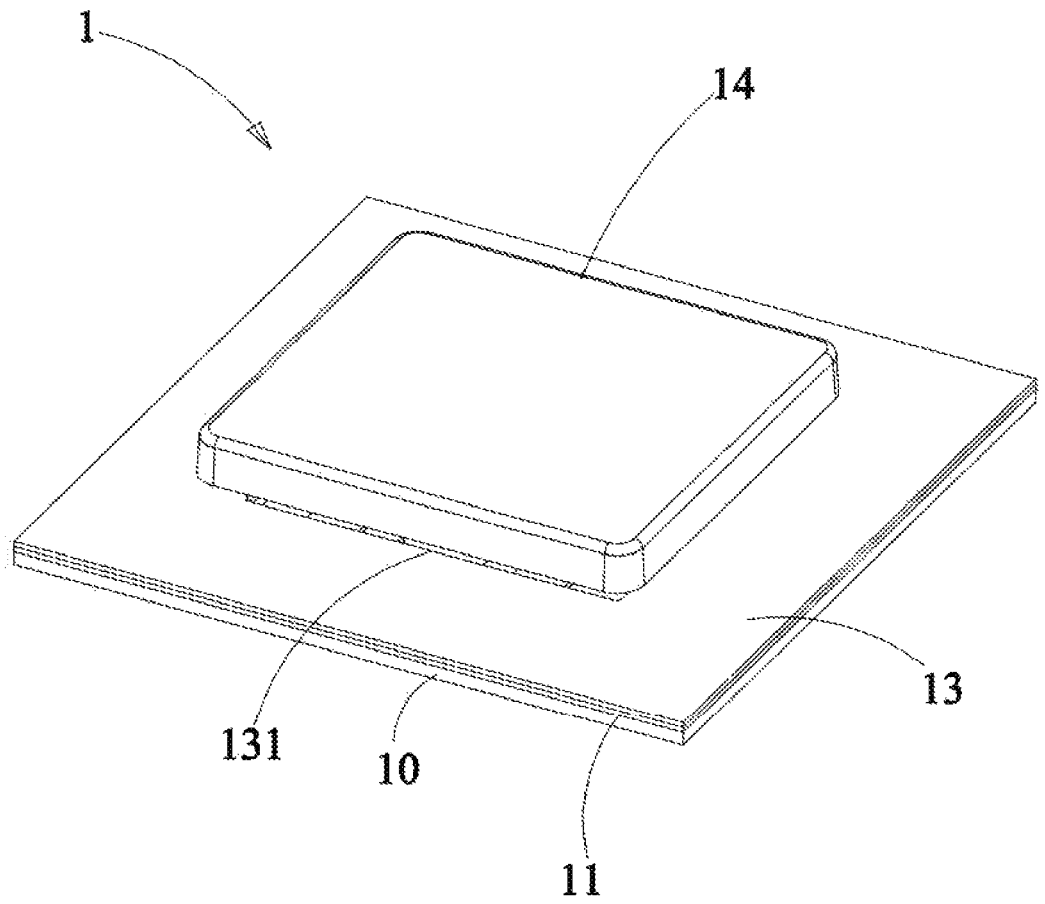
FIG. 1 is a perspective view of a keyswitch of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
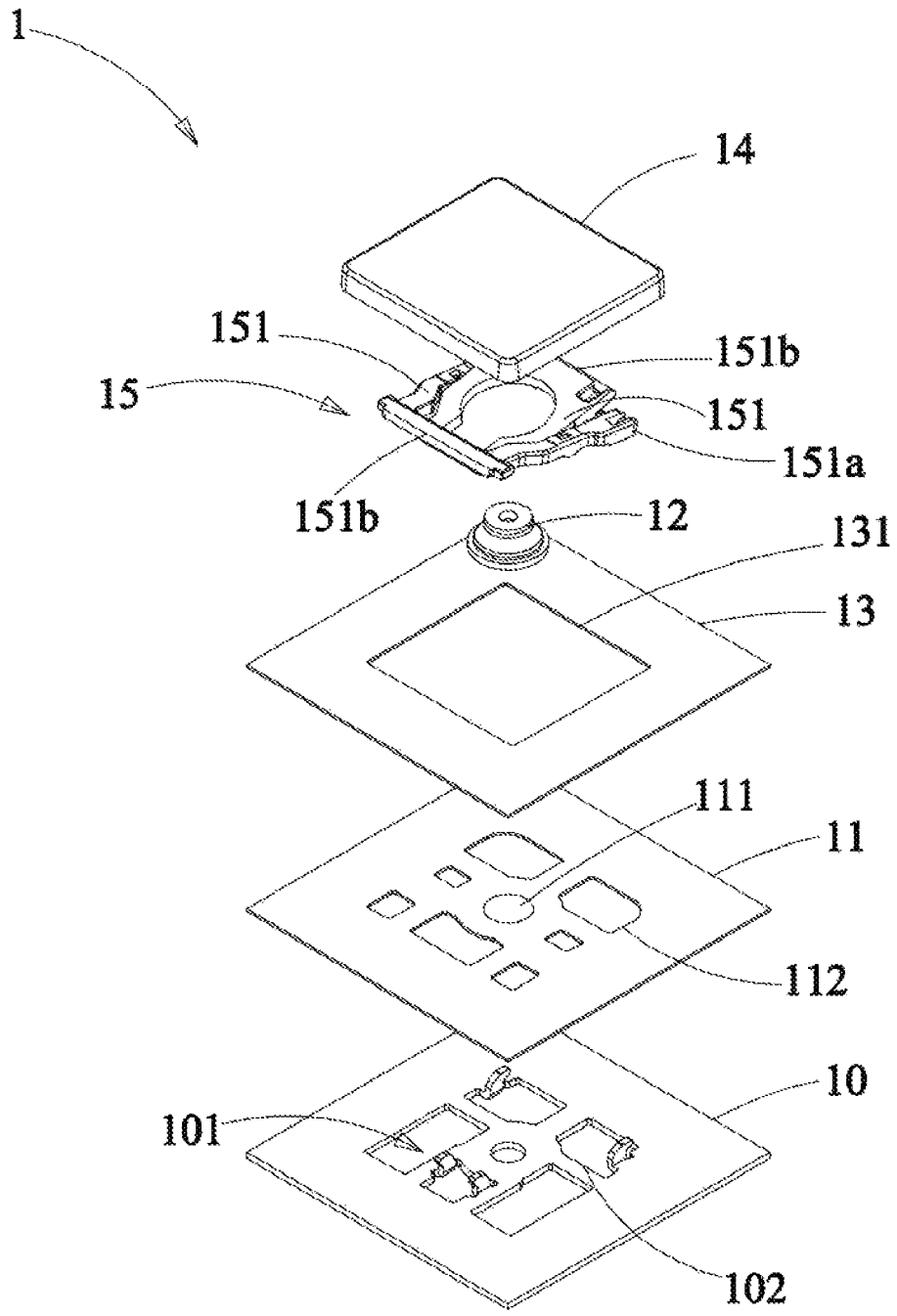
FIG. 2 is an exploded view of the keyswitch of the first embodiment of the present disclosure.
Figure 3:
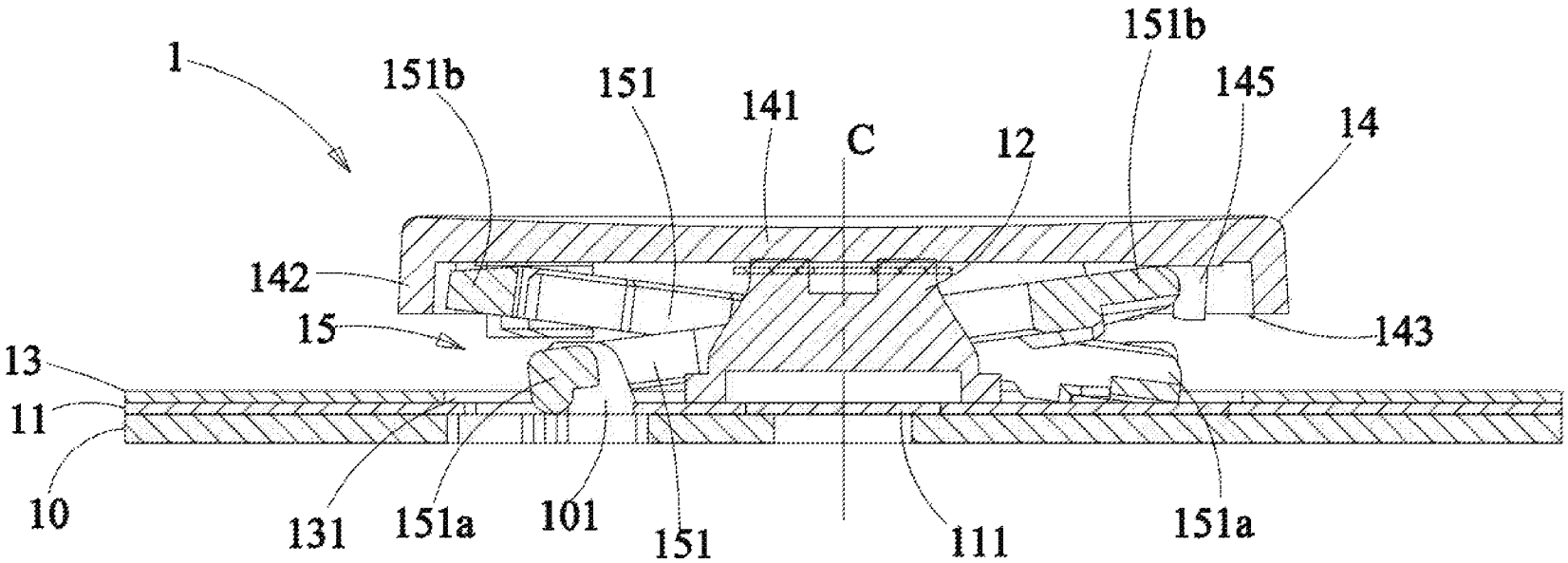
FIG. 3 is a cross-sectional view of the keyswitch of the first embodiment of the present disclosure.

FIG. 1 to FIG. 3 are a perspective view, exploded view, and cross-sectional view of a keyswitch of the first embodiment of the present disclosure. As shown in the figures, the keyswitch 1 of this embodiment includes a baseplate 10, a circuit layer 11, an elastic part 12, a thin film 13, a keycap 14, and a linkage component 15. The circuit layer 11 is disposed on the baseplate 10. A portion of the baseplate 10 is exposed from the circuit layer 11. The elastic part 12 is disposed on the circuit layer 11. In this embodiment, the elastic part 12 is disposed on a surface of the circuit layer 11 away from the baseplate 10. The thin film 13 is disposed on the circuit layer 11. The thin film 13 of this embodiment is disposed on a surface of the circuit layer 11 away from the baseplate 10. The thin film 13 has an opening 131. The elastic part 12 protrudes from the opening 131 of the thin film 13. For example, the elastic part 12 is engaged with the surface of the circuit layer 11 and passes through the opening 131 of the thin film 13. That is, the elastic part 12 is not in contact with the thin film 13. The keycap 14 is disposed on the elastic part 12 and above the thin film 13. Two ends of the linkage component 15 are respectively connected to the baseplate 10 and the keycap 14. In this embodiment, the elastic part 12 is disposed within the linkage component 15. The keycap 14 could move up and down relative to the baseplate 10 with the linkage component 15. The thin film 13 is disposed on the movement path of the keycap 14. When the keycap 14 is pressed and moves toward the baseplate 10, it would first hit the thin film 13 to avoid directly hitting the circuit layer 11. Because the hardness of the material of the thin film 13 is softer than that of the circuit layer 11, the noise of the keycap 14 striking the thin film 13 is lower than that of the keycap 14 striking the circuit layer 11. Thus, the noise of pressing the keyswitch 1 could be reduced.

The circuit layer 11 and the thin film 13 in this embodiment are two independent parts. For example, the circuit layer 11 could be implemented by a membrane circuit layer, including two or three layers of PET (polyethylene terephthalate) films, and the circuits made of conductive material are provided on and sandwiched between the respective surfaces of the opposing PET films, thereby enabling the circuit layer 11 to function as a switch corresponding to a single keycap 14. However, the PET film with the circuit layout may induce greater hardness. Because the thin film 13 is a single-layered cushioning film with pliability, and is made of the material softer than the circuit layer 11, the noise of the keycap 14 striking the thin film 13 is lower than that of the keycap 14 striking the circuit layer 11. The material of the films used in the circuit layer 11 and the material of the thin film 13 could be identical or different. In this embodiment, the material of the films used for the circuit layer 11 and the thin film 13 may both be the PET films, but could be of different hardness. In other embodiments, the thin film for the circuit layer 11 is a PET film, and the thin film 13 may be other plastic or composite materials other than PET, such as TPU (thermoplastic polyurethane). The circuit layer 11 is, for example, thicker than the thin film 13. In general, when the thin film 13 is thicker than or equal to 0.025 mm, the noise reduction mentioned above could be obtained. In another embodiment, when the thin film 13 is thicker than or equal to 0.05 mm but less than or equal to 0.15 mm, the keyswitch 1 would stay in a relatively thin or slim profile and could be near-silent.

In this embodiment, the material of the keycap 14 is plastic. However, when the keycap 14 is made of metal, ceramic, or a more rigid material in other embodiments, the noise of the rigid keycap 14 hitting the circuit layer 11 could be reduced by the intervening thin film 13.

Figure 4:
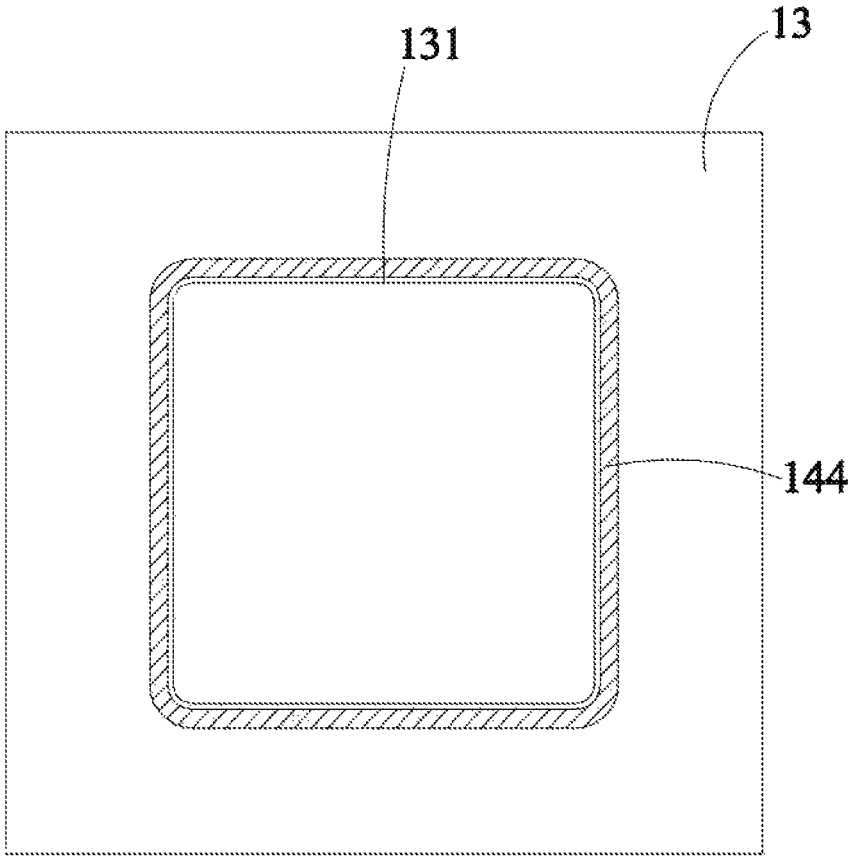
FIG. 4 is a schematic diagram of an orthographic projection area of a keycap projected onto a thin film of the first embodiment of the present disclosure.

The keycap 14 comprises a keycap body 141 and a sidewall 142 connected to a periphery of the keycap body 141. One side of the sidewall 142 away from the keycap body 141 is provided with an accommodating opening 143. A side of the accommodating opening 143 is defined as a side of the inner surface of the sidewall 142 away from the keycap body 141. The area of the opening 131 of the thin film 13 is smaller than the area of the accommodating opening 143. The orthographic projection area 144 projected by an end surface of the sidewall 142 of the keycap 14 facing the thin film 13 is at least partially on the thin film 13. A gap exists between an inner side of the orthographic projection area 144 and a side of the opening 131 (see FIG. 4). In this embodiment, the orthographic projection area 144 of the end surface of the sidewall 142 of the keycap 14 entirely falls within the coverage of the thin film 13. In other words, aligned to a single reference line, the distance from the side of the opening 131 of the thin film 13 to the center C of the elastic part 12 is shorter than the distance from the inner surface of the sidewall 142 of the keycap 14 to the center C of the elastic part 12. In this way, the thin film 13 would be disposed on the movement path of the keycap 14, and the thin film 13 could be sandwiched between the sidewall 142 and the circuit layer 11 when the keycap 14 is pressed. The area of the opening 131 is greater than the maximum area occupied by the linkage component 15. The area occupied by the linkage component 15 is, for example, a cross-sectional area of the linkage component 15 parallel to a top surface of the thin film 13. The linkage component 15 can be completely accommodated in the opening 131, and the movement of the linkage component 15 would not be obstructed by the thin film 13. Thus, the linkage component 15 could be smoothly operated.

In this embodiment, engagement members 101 are provided on a surface of the baseplate 10 close to the circuit layer 11. The engagement members 101 penetrate the circuit layer 11. A surface of the keycap 14 close to the circuit layer 11 is provided with connecting components 145. In this embodiment, the connecting components 145 are disposed on the inner surface of the keycap body 141. As shown in FIGS. 2 and 3, the engagement members 101 are, for example, extension components of the baseplate 10 formed by stamping and bending the material of the baseplate 10. The connecting components 145 are, for example, engaging components integrally formed, through injection molding, on the inner surface of the keycap body 141 when the keycap 14 is fabricated. In other embodiments, the engagement members 101 can be made of a material different from that of the baseplate 10 by, for example, using plastic injection-molded and directly mounted onto the baseplate 10, so that the engagement members 101 is made of plastic. The linkage component 15 is a scissor-like or wing-like frame structure, including two movable parts 151 which are interlocked by a matching shaft and a shaft hole. The two movable parts 151 are rotatably connected by the shaft of one of the movable parts 151 being accommodated in the shaft hole of the other of the movable parts 151. Each of the two movable parts 151 may have a first end 151*a* and a second end 151*b*. The two first ends 151*a* of the two movable parts 151 are disposed on the same side that is close to the baseplate 10. The two second ends 151*b* of the two movable parts 151 are disposed on the same side that is close to the keycap 14. The two first ends 151*a* of the two movable parts 151 are engaged with the engagement members 101 of the baseplate 10. The two second ends 151*b* of the two movable parts 151 are engaged with the connecting components 145 of the keycap 14. In this way, the two ends of the linkage component 15 are respectively connected to the baseplate 10 and the keycap 14.

In this embodiment, the circuit layer 11 might have a first hollow part 112 corresponding to the linkage component 15. The baseplate 10 is exposed from the first hollow part 112. The engagement members 101 penetrate the first hollow part 112 and protrude from the top surface of the circuit layer 11. The baseplate 10 of this embodiment might have a second hollow part 102 which could be partly overlapped by the first hollow part 112. The first hollow part 112 and the second hollow part 102 provide a space for the linkage component 15 to sink when the linkage component 15 is compressed, making the linkage component 15 to be operated stably, and thus the thickness of the keyswitch 1 is reduced for further downsizing the keyswitch 1.

Figure 5:
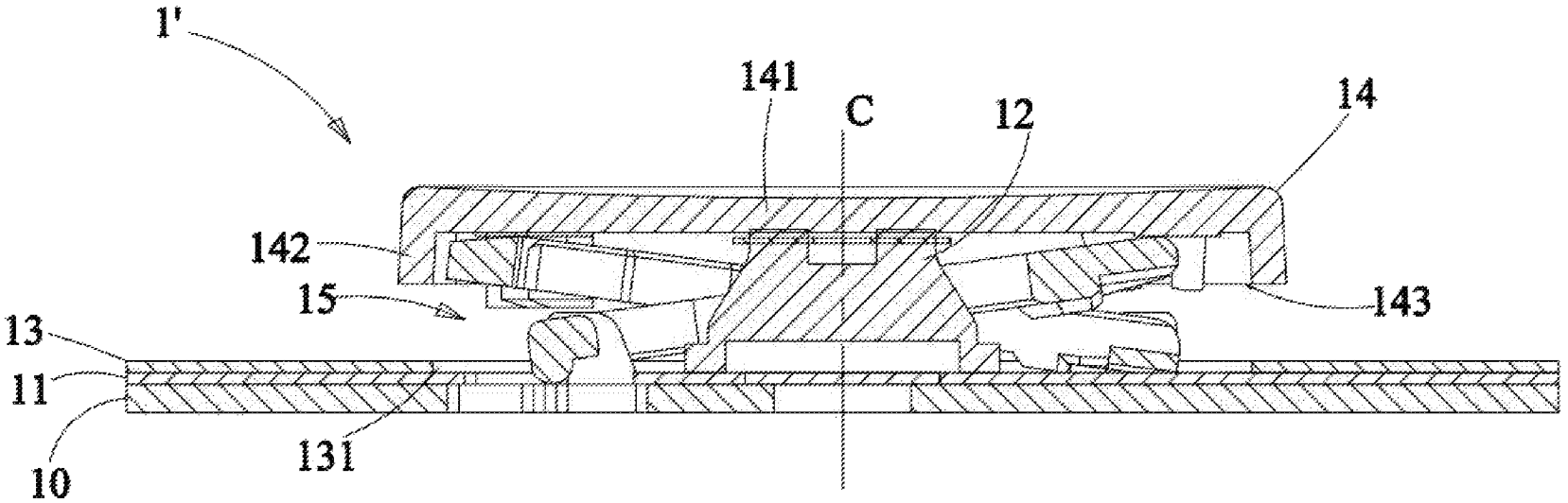
FIG. 5 is a cross-sectional view of a keyswitch of the second embodiment of the present disclosure.
Figure 6:
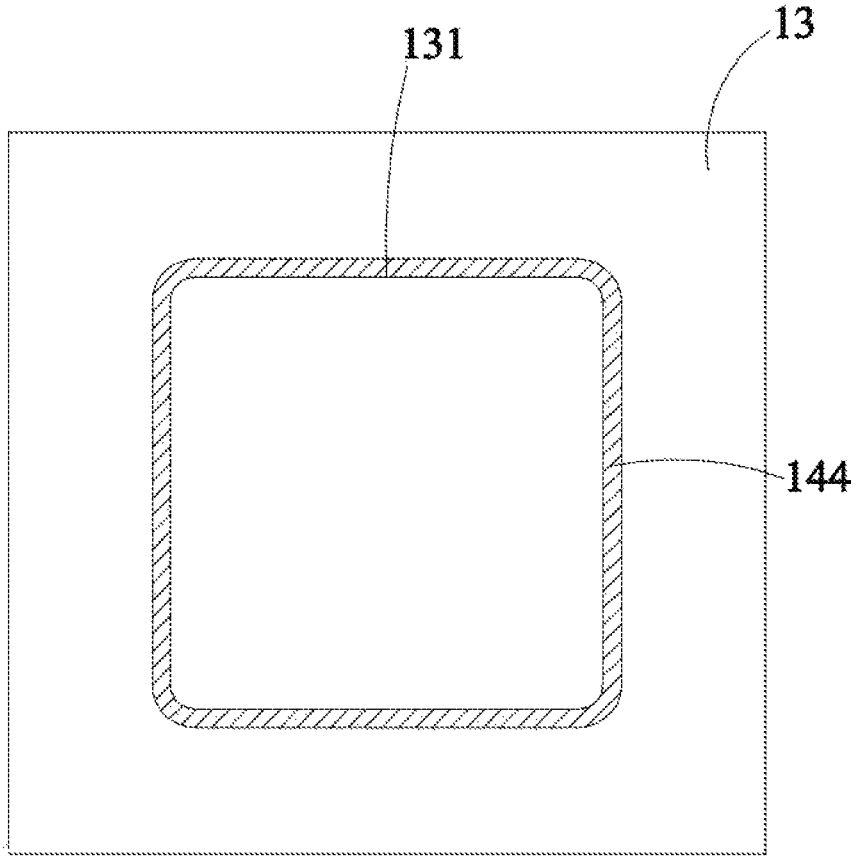
FIG. 6 is a schematic diagram of an orthographic projection area of a keycap projected onto a thin film of the second embodiment of the present disclosure.

FIG. 5 is a cross-sectional view of a keyswitch of the second embodiment of the present disclosure. FIG. 6 is a schematic diagram of an orthographic projection area of a keycap projected onto a thin film of the second embodiment of the present disclosure. As shown in the figures, the keyswitch 1' of this embodiment is different from the keyswitch 1 of the first embodiment in that a side of an opening 131 of a thin film 13 is aligned with the edge of the inner surface of a keycap 14. This indicates that the area of the opening 131 of the thin film 13 is substantially identical to that of an accommodating opening 143 of the keycap 14. The area of the opening 131 of the thin film 13 is the largest in this exemplary embodiment. An orthographic projection area 144 projected by a surface of the sidewall 142 of the keycap 14 facing the thin film 13 falls on the thin film 13. A side of the orthographic projection area 144 close to the opening 131 could be substantially aligned with a side of the opening 131. No gap exists between the side of the orthographic projection area 144 close to the opening 131 and the side of the opening 131. In other words, aligned to a single reference line, the distance from the side of the opening 131 to the center C of the elastic part 12 is substantially equal to the distance from the inner surface of the sidewall 142 of the keycap 14 to the center C of the elastic part 12. As the thin film 13 is still disposed on the movement path of the keycap 14, the noise reduction can also be achieved.

Figure 7:
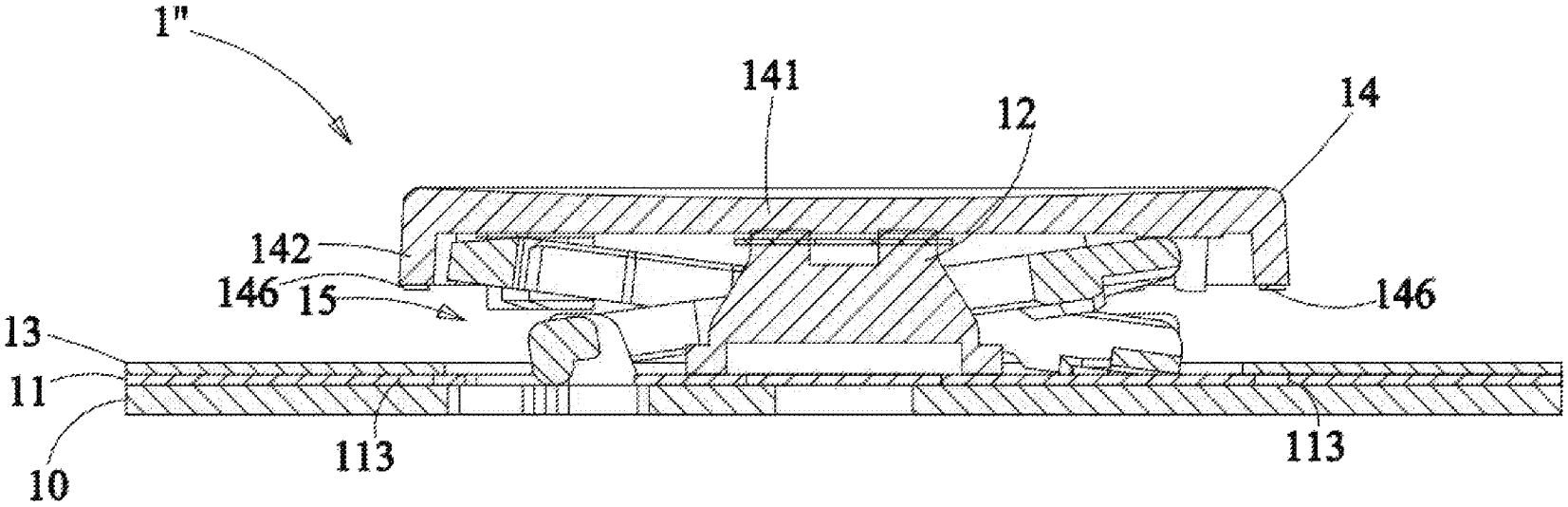
FIG. 7 is a cross-sectional view of a keyswitch of the third embodiment of the present disclosure.

FIG. 7 is a cross-sectional view of a keyswitch of the third embodiment of the present disclosure. As shown in the figure, the keyswitch 1" of this embodiment is different from the keyswitch 1 of the first embodiment in that a buffer bump 146 is provided on an end surface of a sidewall 142 of the keycap 14 of this embodiment. The buffer bump 146 is disposed between the sidewall 142 and the thin film 13. In an embodiment, the buffer bump 146 protrudes from the end surface of the sidewall 142 and faces the thin film 13. When the keycap 14 is pressed and moved toward the thin film 13 with the linkage component 15, the buffer bump 146 contacts the thin film 13 in advance to reduce the impact between the entire sidewall 142 of the keycap 14 and the thin film 13, bringing the keyswitch 1 an enhanced effect of noise reduction. The buffer bump 146 can be an annular-shaped protruding ring or arranged in multiple protruding segments separately formed on the end surface of the sidewall 142 facing the thin film 13. The buffer bump 146 and the keycap 14 may be integrally formed to one piece.

In this embodiment, the circuit layer 11 is further provided with a retaining hole 113 corresponding to the buffer bump 146. That is, the circuit layer 11 is not provided between the thin film 13 and the baseplate 10 below the position corresponding to the buffer bump 146. When the keycap 14 moves toward the thin film 13 with the linkage component 15, the buffer bump 146 would only contact the thin film 13 without metal circuits but would not impact the circuit layer 11 to reduce the noise. The width of the retaining hole 113 in this embodiment is greater than the width of the buffer bump 146, so as to ensure that there is a space below the thin film 13 corresponding to the buffer bump 146. Thus, the buffer bump 146 would not directly hit the circuit layer 11 through the thin film 13 and/or the arrangement of the retaining hole 113. The shape of the retaining hole 113 can be identical to or different from the shape of the buffer bump 146. The retaining hole 113 can be annular, which may correspond to the annular buffer bump 146 or the buffer bump 146 in separate segments. Alternatively, the circuit layer 11 can have multiple retaining holes 113 respectively corresponding to each and every protruding segment of the buffer bump 146.

In another embodiment, the baseplate 10 could include at least one hollow portion corresponding to the buffer bumps 146 in the direction parallel to the movement path. The orthographic projection area of the buffer bump 146 projected onto the thin film 13 is, for example, located within the hollow portion of the baseplate 10, thereby mitigating the stress applied to the baseplate 10 and avoiding the collision between the buffer bumps 146 and the baseplate 10 when the keycap 14 is pressed down.

Figure 8:
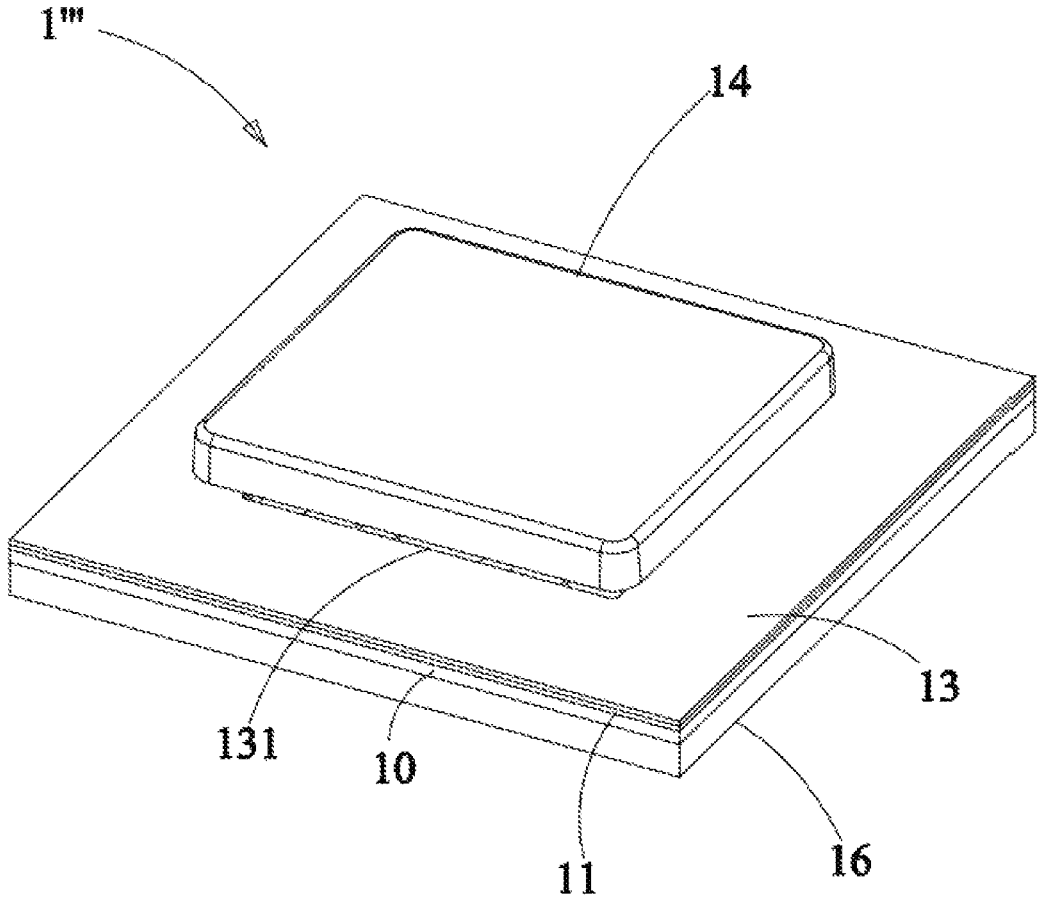
FIG. 8 is a perspective view of a keyswitch of the fourth embodiment of the present disclosure.
Figure 9:
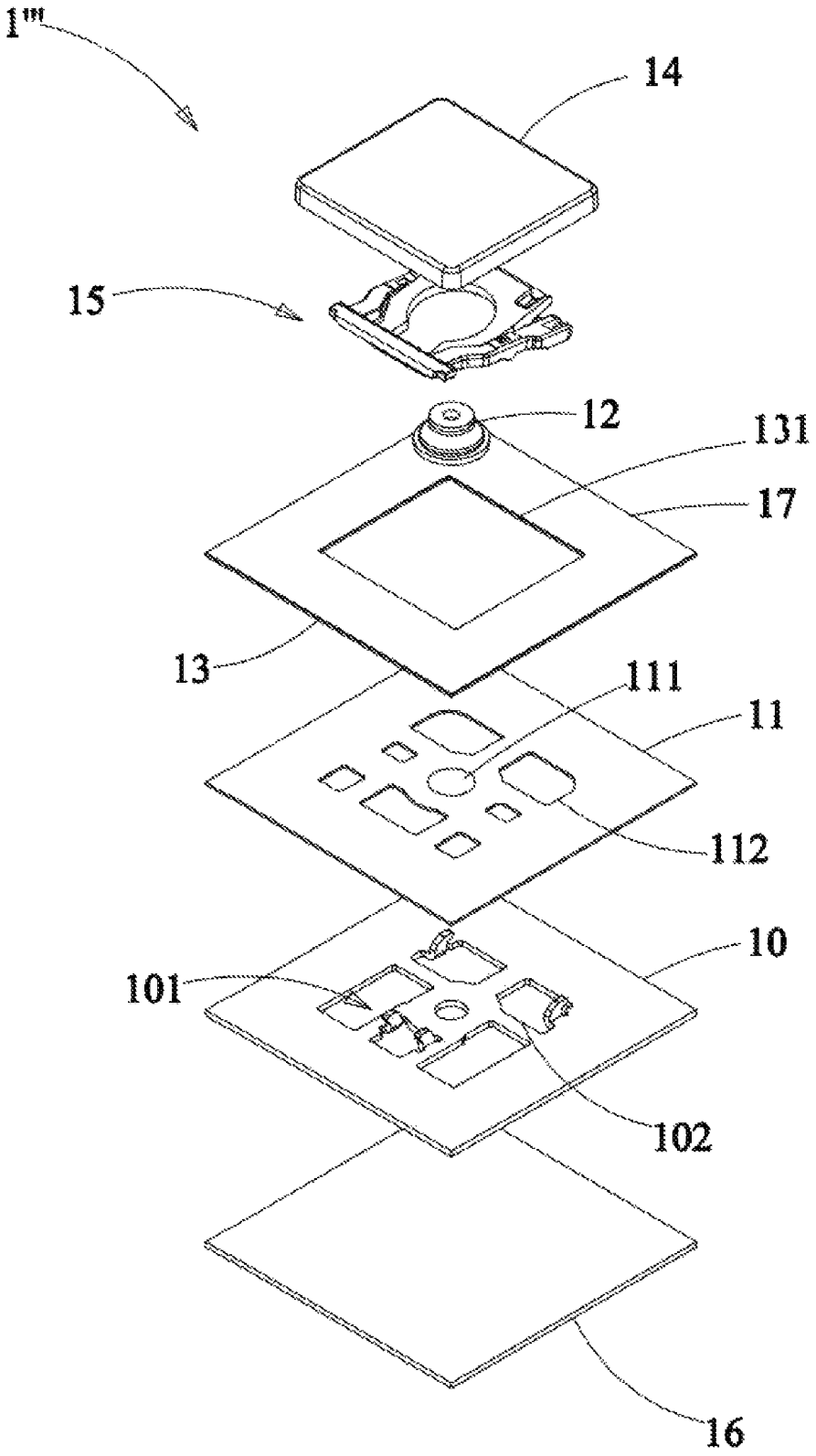
FIG. 9 is an exploded view of the keyswitch of the fourth embodiment of the present disclosure.
Figure 10:
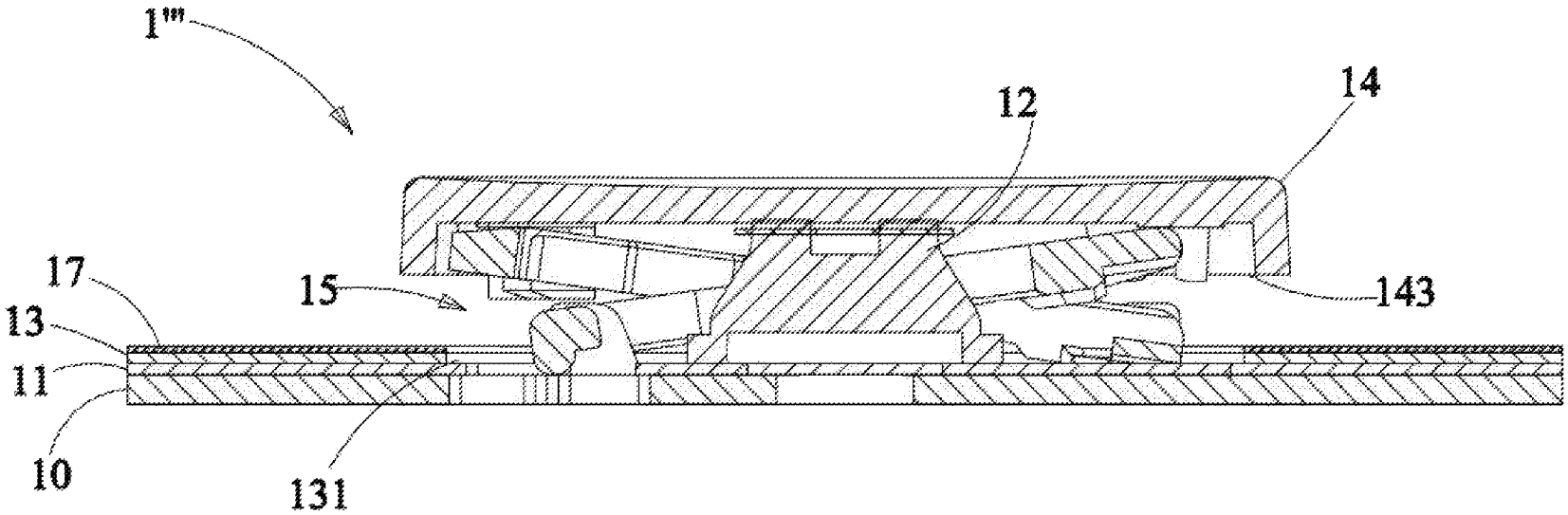
FIG. 10 is a cross-sectional view of the keyswitch of the fourth embodiment of the present disclosure.

FIG. 8 to FIG. 10 are perspective view, exploded view and cross-sectional view of the fourth embodiment of the present disclosure. As shown in the figures, the keyswitch 1''' of this embodiment is different from the keyswitch 1 of the first embodiment in that the keyswitch 1''' further comprises a backlight module 16 disposed below the baseplate 10. In this embodiment, the backlight module 16 is disposed on a surface of the baseplate 10 away from the circuit layer 11. The light generated by the backlight module 16 passes through the second hollow part 102 of the baseplate 10, the first hollow part 112 of the circuit layer 11, and the opening 131 of the thin film 13, finally is emitted from the transparent part on a top surface of the keycap 14 or a gap between adjacent keycaps 14.

A coating 17 is also provided on a surface of the thin film 13 away from the circuit layer 11. In some embodiments, the coating 17 contains a light-reflective material or a light-absorbable material, which could be printed or sprayed on a colorless or transparent film. The color of the coating 17 can be white, beige, black or other colors according to the color of the keycap 14. When the color of the coating 17 is white or other lighter colors, the light would be transmitted from the gap between the thin film 13 and the keycap 14. That is, the light transmitted from the periphery of the keycap 14 would be projected onto the coating 17 that can then reflect the light and generate an improved halo effect, so that the keyswitch 1''' could provide a uniform backlighting attractiveness. When the color of the coating 17 is black or other darker colors, the light reflected by the metal circuit inside the circuit layer 11 would be shielded by the dark coating 17 to uniformize the light emitted from the periphery of the keycap 14. In another embodiment, the thin film 13 could be a tinted translucent film in white, black, or a color the same as the color of the keycap 14. In this way, the same effect as the coating 17 can be achieved through the said tinted translucent film even if the coating 17 is not required.

It is noted that the backlight module 16 can be applied to the keyswitches according to the second and third embodiments, and the coating 17 or the tinted translucent thin film 13 can be optionally implemented in the second and third embodiments. In addition, the backlight module 16 can be selected according to requirements. Practically, the backlight module 16 may include a light guiding plate and a light source disposed at a light-entering side of the light guiding plate. The light guiding plate could evenly distribute the light from the light source. Alternatively, the backlight module 16 could be a plurality of light sources corresponding to the keyswitches; that is, the light source provides independent backlighting for a single keyswitch.

Figure 11:
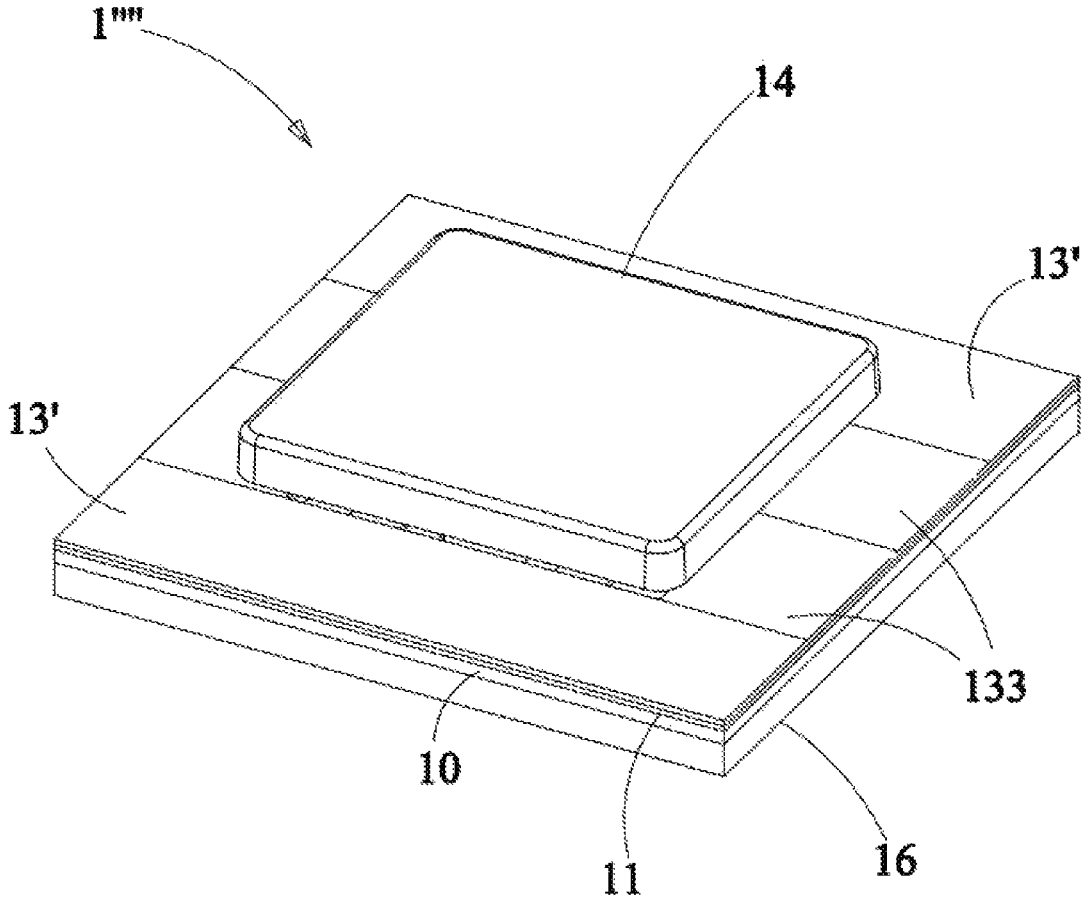
FIG. 11 is a perspective view of a keyswitch of the fifth embodiment of the present disclosure.
Figure 12:
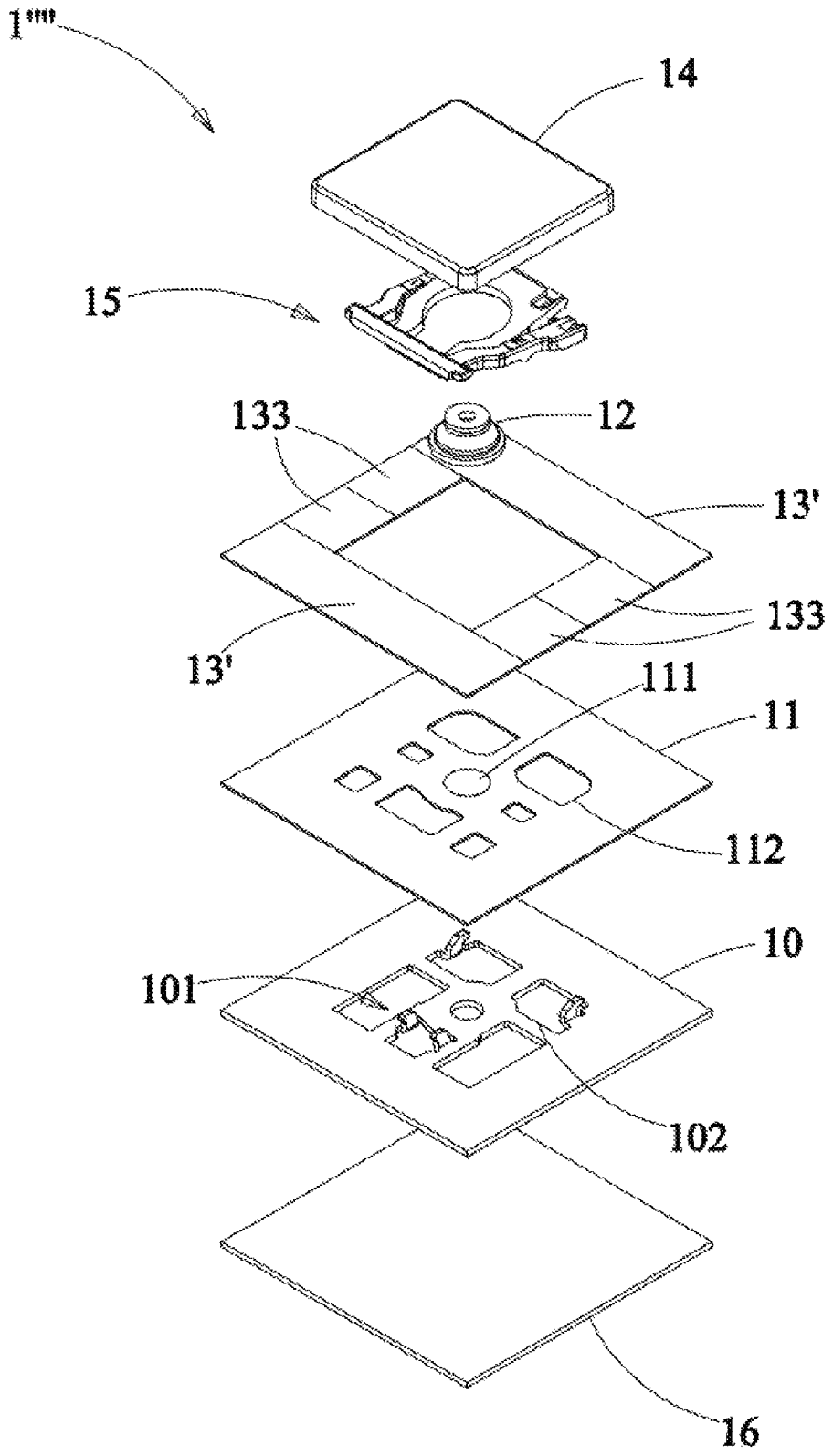
FIG. 12 is an exploded view of the keyswitch of the fifth embodiment of the present disclosure.

FIG. 11 and FIG. 12 are perspective view and exploded view of a keyswitch of the fifth embodiment of the present disclosure. As shown in the figures, the keyswitch 1'''' of this embodiment comprising a baseplate 10, a circuit layer 11, an elastic part 12, at least one thin film 13', a keycap 14, and a linkage component 15. The circuit layer 11 is disposed on the baseplate 10. The circuit layer 11 of this embodiment is disposed on a surface of the baseplate 10 comprising the engagement members 101, and the baseplate 10 passes through the circuit layer 11 and is exposed out of the circuit layer 11, the elastic part 12 is disposed on the circuit layer 11. In this embodiment, the elastic part 12 is disposed on a surface of the circuit layer 11 away from the baseplate 10. The at least one thin film 13' is disposed on the circuit layer 11. Each thin film 13' of this embodiment is disposed on the surface of the circuit layer 11 away from the baseplate 10 and is disposed at the periphery of the elastic part 12. Each thin film 13' and the circuit layer 11 are two independent parts, the keycap 14 is disposed above the at least one thin film 13 and covers the elastic part 12. Two ends of the linkage component 15 are respectively connected to the baseplate 10 and the keycap 14. The linkage component 15 is disposed on a periphery of the elastic part 12. The keycap 14 moves up and down relative to the baseplate 10 with the linkage component 15. The at least one thin film 13' is disposed between the keycap 14 and the circuit layer 11, and is disposed on the movement path of the keycap 14. The keycap 14 of this embodiment comprises a keycap body 141 and four sidewalls 142 disposed on the periphery of the keycap body 141. At least one of the four orthographic projection areas 144 projected by end surfaces of the four sidewalls 142 of the keycap 14 facing the at least one thin film 13' is on the at least one thin film 13'.

Figure 13:
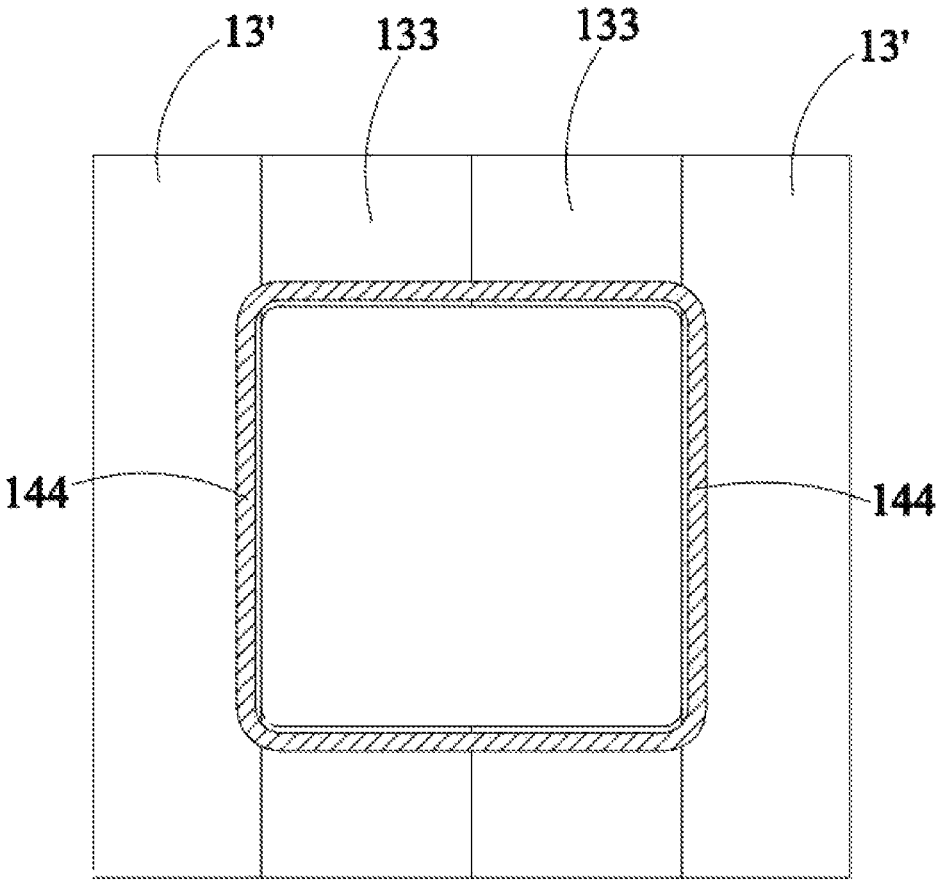
FIG. 13 is a schematic diagram of an orthographic projection area of a keycap projected onto a thin film of the fifth embodiment of the present disclosure.

In this embodiment, the number of thin films 13' is two. The two thin films 13' are oppositely disposed on opposite sides of the linkage component 15. A gap exists between the two thin films 13'. The width of the gap is greater than or equal to the length of a side of the linkage component 15 parallel to a side of the thin films 13'. So that the linkage component 15 can be completely disposed in the gap between the two thin films 13'*m* which would not affect the operation of the linkage component 15 or would not contact the linkage component 15. Referring to FIG. 13, a schematic diagram of an orthographic projection area of a keycap projected onto a thin film of the fifth embodiment of the present disclosure, two orthographic projection area 144 projected by end surfaces of two opposite sidewalls 142 facing the thin films 13' is respectively on the at least one thin film. A gap exists between a side of each orthographic projection area 144 on each thin film 13' close to the linkage component 15 and a side of the thin films 13' close to the linkage component 15. Alternatively, the side of each orthographic projection area 144 on each thin film 13' close to the linkage component 15 is aligned with the side of the thin film 13' close to the linkage component 15. In this embodiment, a gap exists between the side of each orthographic projection area 144 on each thin film 13' close to the linkage component 15 and a side of the thin films 13' close to the linkage component 15. That is, the distance between the side of each orthographic projection area 144 on each thin film 13' close to the linkage component 15 and the center of the elastic part 12 is greater than the distance between the side of the thin films 13' close to the linkage component 15 and the center of the elastic part 12.

Two add-on thin films 133 are provided on one side of each thin film 13', and the two add-on thin films 133 extend toward the other thin films 13'. A gap exists between the two add-on thin films 133 of each thin film 13'. The width of the gap is greater than or equal to the maximum length of the side of the linkage component 15 parallel to the extending direction of the add-on thin films 133, making the linkage component 15 to be disposed within the two add-on thin films 133. The two add-on thin films 133 of each thin film 13' would not affect the operation of the linkage component 15 or would not be in contact with the linkage component 15.

The two add-on thin films 133 of each thin film 13' abut against the two add-on thin films 133 of another thin film 13', so that an opening is formed between the two thin films 13' as that of the embodiment 1. The function of the thin film 13' in this embodiment is identical to the function of the thin film 13 in the foregoing embodiments, thus the details would not be described again herein.

In this embodiment, the baseplate 10 and the circuit layer 11 are identical to the baseplate and the circuit layer of the first embodiment. The circuit layer 11 comprises a first hollow part 112. The baseplate 10 comprises a second hollow part 102. At least a part of the second hollow part 102 corresponds to the first hollow part 112. The keyswitch 1"" of this embodiment further comprises a backlight module 16 disposed below the baseplate 10. That is, the backlight module 16 is disposed on a surface of the baseplate 10 away from the circuit layer 11. The light generated by the backlight module 16 passes through the second hollow part 102 of the baseplate 10, the first hollow part 112 of the circuit layer 11, and the gap between the two thin films 13', and would be finally emitted from the periphery of the keycap 14.

The thin film 13' of this embodiment could further be provided with a coating of the fourth embodiment or could be applied with the translucent film of the fourth embodiment to uniformize the light emitted from the periphery of the keycap 14 and/or to produce a better halo effect. In this way, the keyswitch 1"" could present an effect of excellent lighting in uniformity. The thin film thickness range, the thin film material, and the material of the keycap of the first embodiment, the buffer bumps and the retaining holes of the circuit layer of the second embodiment could be applied to the keyswitch 1"" of this embodiment, thus the details would not be described again herein.

It can be known from the above embodiments that the thin films of the keyswitch are disposed between the circuit layer and the sidewall of the keycap. The orthographic projection area projected by the end surface of the sidewall of the keycap facing the thin film is at least partially on the thin films, which indicates that at least the orthographic projection area projected by the outer edge of the keycap facing the thin films is on the thin films. Therefore, the thin films can be disposed between the circuit layer and the keycap and can be disposed on the movement path of the keycap. When the keycap is pressed, the keycap can be in contact with the thin films to improve the noise reduction effect of the keyswitch.

The present disclosure further provides a keyboard comprising a housing and a plurality of keyswitches disposed in the housing. The keyswitches here could be any of the keyswitches mentioned in the first to fifth embodiments.

In summary, the present disclosure proposes a keyswitch, in which the keycap would not directly impact the circuit layer by disposing the thin film on the circuit layer and at a position corresponding to the movement path of the keycap. The thin film could function as a cushioning film with pliability, which eliminates the impacting noise of the keyswitch. In addition, by disposing coating on the surface of the thin film away from the circuit layer, or applying tinted and translucent film on the circuit layer, the uniformity of the light emitted from the periphery of the keycap could be improved, thereby obtaining an advantageous halo effect and a uniformized backlighting of the keyswitch.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A keyswitch, comprising:

a baseplate comprising at least one first hollow portion and engagement members disposed on the baseplate and adjacent to the first hollow portion;

a circuit layer disposed on the baseplate, and comprising at least one second hollow portion partially overlapping the first hollow portion;

an elastic part disposed on the circuit layer, wherein the elastic part overlaps one of the first hollow portion of the baseplate;

a thin film disposed on the circuit layer and being provided with an opening corresponding to the first hollow portion and the second hollow portion, wherein the elastic part protrudes from the opening;

a keycap disposed on the elastic part, and comprising a keycap body with a protrusion protruding from a lower surface of the keycap and with connecting components disposed on an inner surface of the keycap body, wherein the protrusion has an orthographic projection overlapping the first hollow portion of the baseplate;

a linkage component respectively connected to the engagement members of the baseplate and the connecting components of the keycap, wherein the first hollow portion and the second hollow portion provide a space for the linkage component when the keyswitch is pressed; and a coating provided on a surface of the thin film away from the circuit layer;

wherein the linkage component drives the keycap to move upward and downward relative to the baseplate, and the thin film is located at a position corresponding to a movement path of the keycap;

wherein a gap is disposed between an edge of the coating and an edge of the second hollow portion of the circuit layer corresponding to the sidewall of the keycap.

2. The keyswitch according to claim 1, wherein the keycap further comprises a sidewall disposed on a periphery of the keycap body, an accommodating opening is defined by the sidewall, and an area of the opening of the thin film is smaller than or equal to an area of the accommodating opening.

3. The keyswitch according to claim 2, wherein an orthographic projection area of an end surface of the sidewall at least partially overlaps the thin film.

4. The keyswitch according to claim 3, wherein a gap exists between an inner side of the orthographic projection area and a side of the opening, or, the inner side of the orthographic projection area is aligned with the side of the opening.

5. The keyswitch according to claim 2, wherein the keycap has a buffer bump protruding from an end surface of the sidewall and facing the thin film, and the first hollow portion corresponding to the buffer bump in a direction parallel to the movement path.

6. The keyswitch according to claim 1, wherein an area of the opening is larger than a maximum area occupied by the linkage component, and the area occupied by the linkage component is parallel to a top surface of the thin film.

7. The keyswitch according to claim 1, wherein the circuit layer is thicker than the thin film, and a bottom surface of the elastic part is bonded to the circuit layer without contacting the thin film.

8. A keyswitch, comprising:

a backlight module;

a baseplate comprising first hollow parts and being disposed on the backlight module;

a circuit layer disposed on the baseplate, wherein the circuit layer comprises a second hollow part partially overlapping one of the first hollow parts, and light generated by the backlight module disposed on a surface of the baseplate away from the circuit layer passes through the first hollow parts of the baseplate and the second hollow part of the circuit layer;

a coating disposed on the circuit layer except on the second hollow part of the circuit layer;

an elastic part disposed on the circuit layer to overlap another one of the first hollow parts of the baseplate;

a keycap disposed on the elastic part, the keycap comprising a keycap body and a sidewall connected to a periphery of the keycap body; and a linkage component having two ends respectively connected to the baseplate and the keycap;

wherein an orthographic projection area of an outer edge of the keycap at least partially overlaps the coating;

wherein a gap is disposed between an edge of the coating and an edge of the second hollow part of the circuit layer corresponding to the sidewall of the keycap.

9. The keyswitch according to claim 8, further comprising a thin film disposed between the keycap and the circuit layer when the keycap is pressed, wherein the thin film being provided with an opening corresponding to the first hollow portion and the second hollow portion is made of a material softer than the circuit layer.

10. The keyswitch according to claim 8, wherein a buffer bump is provided on an end surface of the sidewall of the keycap, and the circuit layer further comprises a retaining hole corresponding to the buffer bump.

11. The keyswitch according to claim 9, wherein a thickness of the thin film is thicker than or equal to 0.025 mm.

12. The keyswitch according to claim 9, wherein the thin film and the circuit layer are two independent parts, the thin film does not contact the elastic part.

13. The keyswitch according to claim 8, wherein the keycap is made of plastic, metal or ceramic.

14. The keyswitch according to claim 9, wherein the thin film is a tinted translucent film, and the thin film and the keycap are of the same color.

15. The keyswitch according to claim 8, wherein the coating comprises a light-absorbable material.

16. The keyswitch according to claim 8, wherein the baseplate further comprises engagement members disposed on the baseplate and adjacent to the first hollow part, the keycap body has a protrusion protruding from a lower surface of the keycap and connecting components disposed on an inner surface of the keycap body, and the two ends of the linkage component respectively connect to the engagement members of the baseplate and the connecting components of the keycap.

17. A keyswitch, comprising:

a baseplate comprising first hollow parts;

a circuit layer disposed on the baseplate and comprising at least one second hollow portion partially overlapping one of the first hollow parts;

an elastic part disposed on the circuit layer overlapping another one of the first hollow parts of the baseplate;

at least one thin film disposed on the circuit layer and being provided with an opening corresponding to the first hollow parts and the second hollow portion, wherein the thin film and the circuit layer are two independent parts;

a keycap disposed above the at least one thin film, the keycap covering the elastic part;

a linkage component having two ends respectively connected to the baseplate and the keycap, and being disposed around a periphery of the elastic part; and a coating provided on a surface of the at least one thin film away from the circuit layer;

wherein the keycap is configured to move up and down relative to the baseplate, and the at least one thin film is disposed between the keycap and the circuit layer;

wherein light emitted from a backlight module from a surface of the baseplate away from the circuit layer upwardly passes through the first hollow parts of the baseplate and the elastic part;

wherein a gap is disposed between an edge of the coating and an edge of the at least one second hollow portion of the circuit layer corresponding to the sidewall of the keycap.

18. The keyswitch according to claim 17, wherein the keycap comprises a keycap body and a sidewall disposed on a periphery of the keycap body, and an orthographic projection area of an end surface of the sidewall facing the thin film is located on the at least one thin film.

19. The keyswitch according to claim 17, wherein two thin films are disposed on two opposite sides of the linkage component with a first gap therebetween, and a width of the first gap is greater than or equal to a lateral length of the linkage component parallel to or perpendicular to a long side of the thin film.

20. The keyswitch according to claim 19, further comprising two add-on thin films provided between the two thin films, wherein a second gap exists between the two add-on thin films, and a width of the second gap is greater than or equal to a maximum lateral length of the linkage component parallel to an extending direction of the add-on thin films.

* * * * *